US005315715A

United States Patent [19]

Kronenberger

[11] Patent Number: 5,315,715

[45] Date of Patent: May 31, 1994

[54] HEADWEAR PIECE WITH DEFORMABLE CUSHION LAYER

[75] Inventor: Robert A. Kronenberger, Buffalo Grove, Ill.

[73] Assignee: American Needle, Buffalo Grove, Ill.

[21] Appl. No.: 931,879

[22] Filed: Aug. 18, 1992

[51] Int. Cl.[5] ..... A42B 1/22

[52] U.S. Cl. ..... 2/183; 2/413; 2/DIG. 10; 2/DIG. 11

[58] Field of Search ..... 2/181, 181.2, 181.6, 2/181.8, 182.1, 182.3, 182.5, 182.6, 183, 184, 197, 411, 412, 413, 417, 418, DIG. 10, DIG. 11; 602/13, 17

[56] References Cited

U.S. PATENT DOCUMENTS

| | | | |
|---|---|---|---|
| 1,510,482 | 10/1924 | Kramer | 2/183 |
| 1,681,111 | 8/1928 | Garfield | 2/183 |
| 2,263,395 | 11/1941 | Page | 2/181 |
| 3,047,879 | 8/1962 | Spreiregen | 2/181 |
| 5,031,246 | 7/1991 | Kronenberger | 2/183 |
| 5,095,545 | 3/1992 | Lane | 2/413 |
| 5,129,106 | 7/1992 | Liou | 2/413 |

FOREIGN PATENT DOCUMENTS

| | | | |
|---|---|---|---|
| 2134370 | 8/1984 | United Kingdom | 2/411 |

*Primary Examiner*—Clifford D. Crowder
*Assistant Examiner*—Diana L. Biefeld
*Attorney, Agent, or Firm*—Wood, Phillips, VanSanten, Hoffman & Ertel

[57] ABSTRACT

A headwear piece having a crown with a surface defining an opening for receiving the head of a wearer, a bladder having first and second layers defining a space therebetween for containing a displaceable fluid, structure for connecting the first and second layers to each other to divide the bladder space into first and second chambers with their being a communication path through the bladder space between the first and second chambers, and structure for connecting the bladder to the crown so that the bladder defines a deformable cushion layer to conform to the head of a wearer.

39 Claims, 2 Drawing Sheets

HEADWEAR PIECE WITH DEFORMABLE CUSHION LAYER

BACKGROUND OF THE INVENTION

1. Field of the Invention

This invention relates to headwear and, more particularly, to a headwear piece with a cushion layer around a crown opening to facilitate conformance of the crown opening to the head of a wearer.

2. Background Art

The inventor herein recently made a significant improvement to conventional headwear. That improvement is disclosed in U.S. Pat. No. 5,031,246 ("the '246 patent").

The invention in the '246 patent is directed to a headwear piece with a bladder on the crown that provides a deformable cushion layer between the crown and the wearer's head. The bladder and at least a portion of the crown are deformable to conform to the wearer's head. In one aspect of the invention in the '246 patent, the bladder can be selectively inflated and deflated to alter the effective diameter of the head-receiving opening on the headwear piece.

In commercially producing headwear according to the '246 patent, the inventor has encountered certain problems which the present invention overcomes. One such problem involves the bladder formation. The use of a plurality of small bladders in fluid communication with each other through small tubes, as described in the '246 patent, results in good conformity of the headwear piece to the head of a wearer. However, it is a relatively costly and complicated process to provide individual bladders and interconnect the bladders so as to allow communication of the fluid therebetween.

One alternative to providing separate bladder sections is to define the bladder using a continuous, flexible tube. The problem with a continuous tube is one that can be identified by attempting to reconfigure an inflated bicycle tube. The tube tends to resist a change from a circular shape, such as a change to oval which approximates the shape of a wearer's head. By forcing the tube into an oval shape, it will normally kink in different locations. With such a bladder incorporated into a headwear piece, uneven pressure may be applied around the circumference of the wearer's head as the bladder reconfigures. There also may be a tendency of the headwear piece to squeeze off of the wearer's head.

Another problem encountered by the inventor is that of securely connecting the bladder to the crown in a cost effective manner. While the sweatband is readily sewn onto the crown, the bladder portion confining the displaceable fluid cannot be punctured by a connecting thread to allow stitching. While the bladder connecting arrangement in the '246 patent does function effectively, there is room for improvement, particularly to facilitate production of headwear pieces on a high volume basis.

Further, the one way valve disclosed in the '246 patent, while fully functional as disclosed in that patent, does not lend itself to economical production on a commercial basis.

SUMMARY OF THE INVENTION

The present invention is directed principally to improving the basic structure shown in U.S. Pat. No. 5,031,246 to provide a high integrity headwear piece that can be economically and effectively produced on a high volume basis.

More specifically, the invention contemplates a headwear piece having a crown with a surface defining an opening for receiving the head of a wearer, a bladder having first and second layers defining a space therebetween for containing a displaceable fluid, structure for connecting the first and second layers to each other to divide the bladder space into first and second chambers with their being a communication path through the bladder space between the first and second chambers, and structure for connecting the bladder to the crown so that the bladder defines a deformable cushion layer to conform to the head of a wearer.

The above arrangement facilitates reconfiguring of the bladder to conform to the crown opening.

The connection of the first and second layers can be effected by bonding with an adhesive. Alternatively, with the bladder made of rubber or plastic, the connection can be effected by heat fusing. Alternatively, a separate piece can be used to effect this connection.

In one form, the bladder is made from a single piece that extends through at least 270° around the crown opening.

To facilitate connection of the bladder to the crown, the first and second layers can be bonded to define a mounting portion which can be stitched to the crown.

To shield the bladder from the head of a wearer, in one form, a sweatband is provided. The sweatband is connected to at least one of the crown and bladder so that the bladder resides between the crown and sweatband on the completed headwear piece.

In one form, the bladder has top and bottom edges and the sweatband is connected to the bladder along at least one, and preferably along both, of the top and bottom edges of the bladder. To facilitate this, the first and second layers can be bonded/heat fused along one of the edges to allow that portion of the bladder to be stitched.

In one form, the sweatband wraps around both the top and bottom edges of the bladder. Stitching extends through the bladder and at least two layers of the sweatband at one edge of the bladder. At the other edge of the bladder, the stitching extends through the bladder, two layers of the sweatband, and into the crown.

In one form, the stitching on the other bladder edge extends fully around the bladder, and at least through 270°. The stitching on the one edge extends into the crown at one location through no more than 90° around the crown.

To facilitate stitching, at least that portion to which the bladder attaches is made from a deformable material, such as fabric. One exemplary hat construction is a baseball-type cap.

The invention further contemplates the provision of a mechanism for directing a displaceable fluid into, and allowing exhausting of the fluid from, the bladder space. In one form, a depressible actuator is provided with their being a receptacle integrally formed on the crown to accommodate the actuator. The receptacle preferably is a membrane that is deformable to allow operation of the actuator from externally of the crown.

A relief valve can be provided to allow exhausting of the fluid from the bladder. In one form, there is provision to exhaust the fluid to externally of the cap so as not to discharge the fluid against a wearer's head.

The invention also contemplates a headwear piece having a crown with a surface defining an opening for receiving the head of a wearer, a tubular bladder defining a space for containing a displaceable fluid, with their being a restriction in the space at a first location so that the bladder tends to bend at the first location to conform to the contour of the crown opening, and structure for connecting the bladder to the crown so that the bladder defines a deformable cushion layer to conform to the head of a wear.

The invention still further contemplates a headwear piece having a crown with a surface defining an opening for receiving the head of the wearer, a bladder defining a space for containing a displaceable fluid and having top and bottom edges, and structure for connecting the sweatband and bladder to the crown so that the bladder defines a deformable cushion layer to conform to the head of a wearer. The sweatband wraps around at least one of the top and bottom edges of the bladder.

In one form, there is structure other than the crown and sweatband for facilitating bending of the bladder to conform to the crown opening.

DETAILED DESCRIPTION OF THE DRAWINGS

Figure 1:
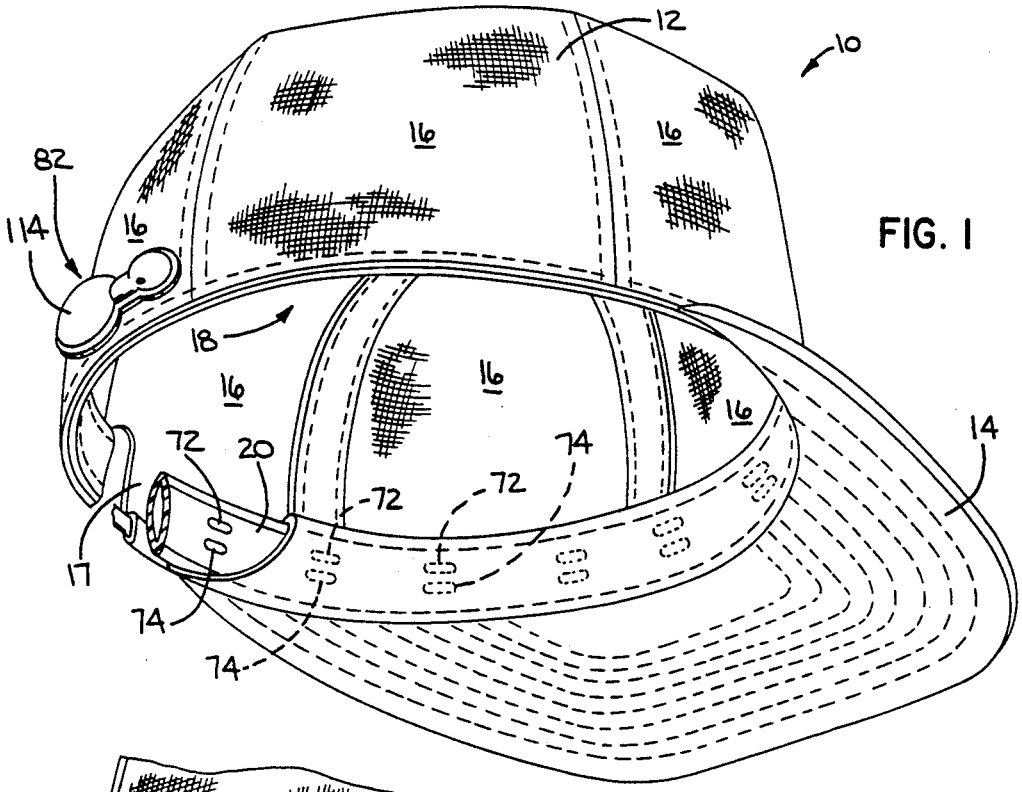
FIG. 1 is a bottom perspective view of a baseball-type cap having a bladder defining a deformable cushion layer according to the present invention.
Figure 2:
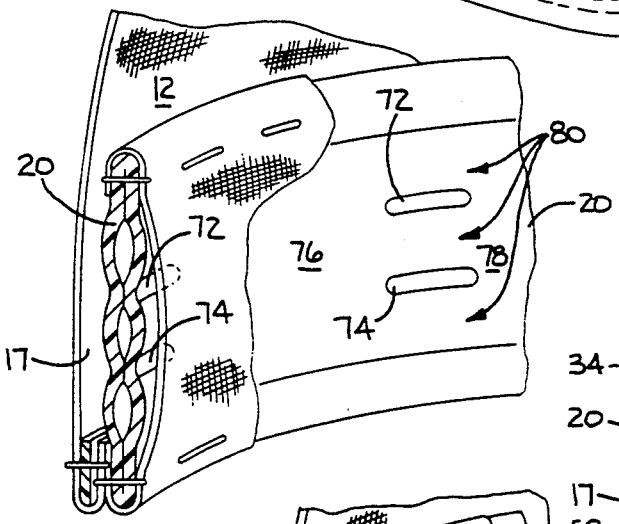
FIG. 2 is an enlarged, fragmentary perspective view of a portion of the bladder showing the pattern of fluid flow through a restricted portion thereof.
Figure 3:
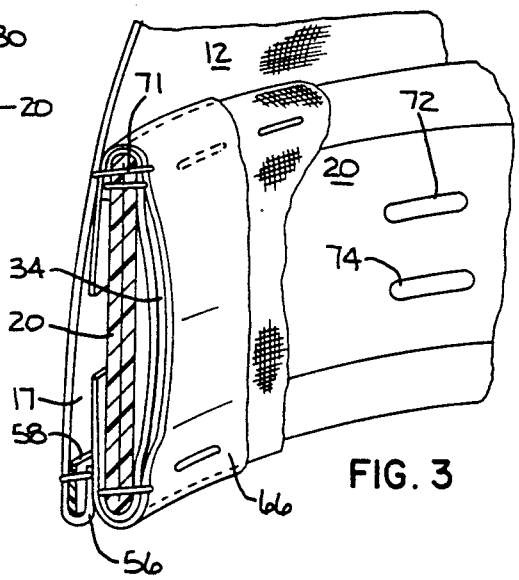
FIG. 3 is an enlarged, fragmentary perspective view of the bladder showing connection of the bladder to the crown of the cap at both top and bottom edges thereof.

An exemplary headwear piece is shown at 10 that is suitable for incorporation of the present invention. The headwear piece 10 is a baseball-type cap, however, it should be recognized that the invention is useable in virtually all different types of headwear having a crown to embrace a wearer's head. For example, the headwear piece could be a visor, a hat, etc.

The cap 10 has an inverted, cup-shaped crown 12 to which a bill/visor 14 is affixed to project forwardly therefrom. The crown 12 is defined by six fabric gores 16 sewn together along adjacent, abutting edges. The lower edge 17 of the crown 12 bounds an opening 18 to accommodate a wearer's head.

A bladder 20 is attached to the crown 12 and defines a deformable cushion layer between the crown edge 17 and the head of a wearer. The advantages afforded by the bladder 20 are described more fully in U.S. Pat. No. 5,031,246, which is incorporated herein by reference.

Figure 4:
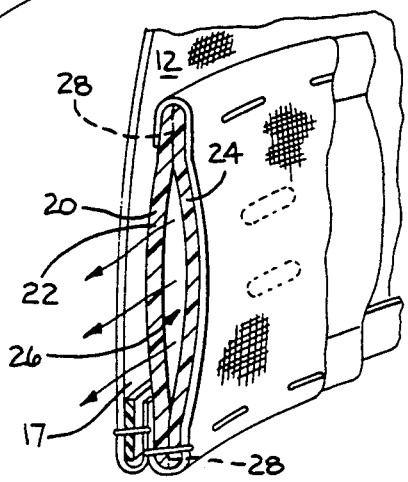
FIG. 4 is an enlarged, fragmentary, perspective view of the portion of the bladder showing the pattern of fluid flow through an unrestricted portion of the bladder.
Figure 5:
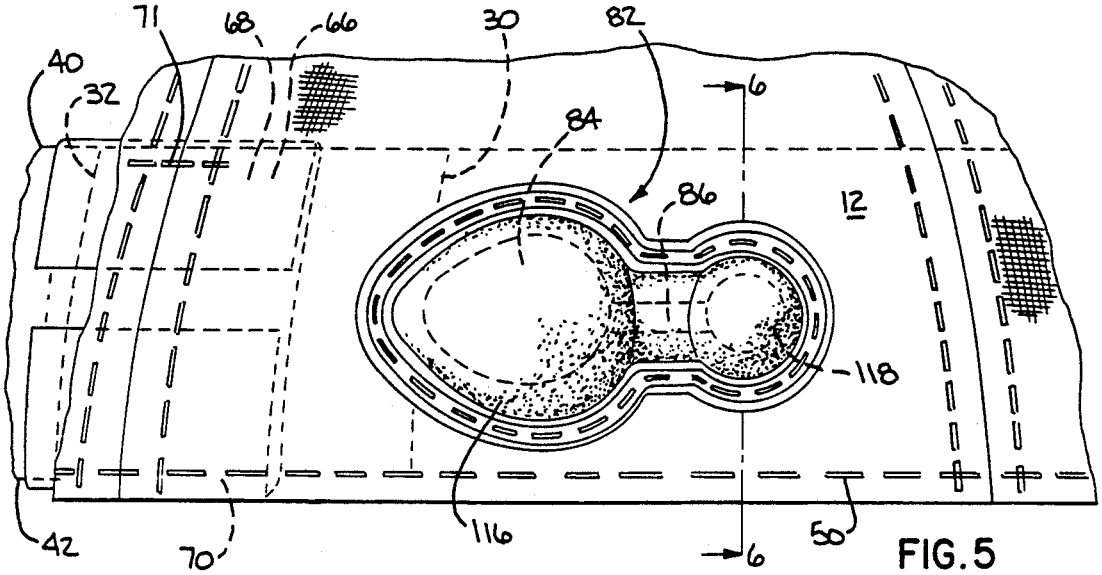
FIG. 5 is an enlarged, fragmentary, rear elevation view of the cap and showing the external portion of a structure for directing a displaceable fluid into, and allowing exhausting of the displaceable fluid from, the bladder externally of the cap.
Figure 8:
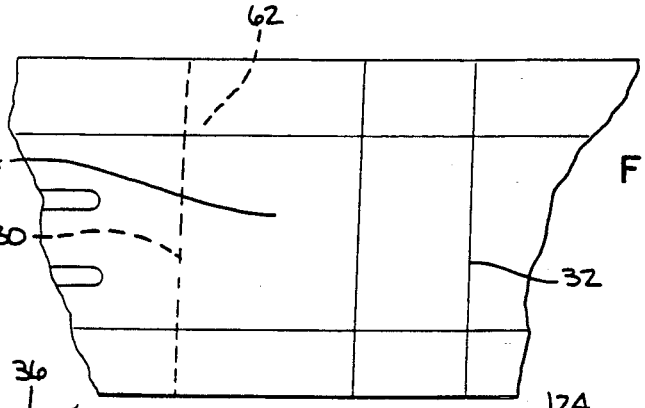
FIG. 8 is an enlarged, fragmentary front elevation view of the connection of the ends of the bladder.
Figure 6:
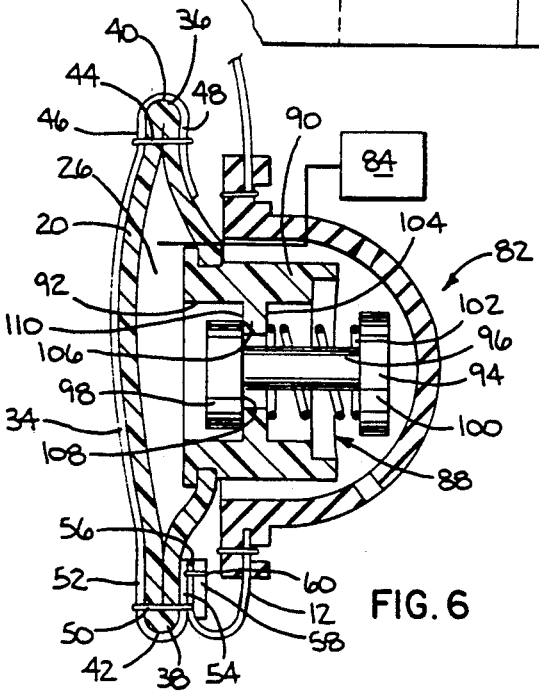
FIG. 6 is a cross-sectional view of a structure for exhausting a displaceable fluid from the bladder and taken along line 6—6 of FIG. 5, with the exhausting structure in its normal state.

The bladder 20 extends through at least 270° around the crown opening 18 and, in a preferred form, extends through substantially 360° to define a continuous structure to embrace the head of a wearer. The assembled bladder 20 has first and second layers 22, 24 which cooperatively bound an airtight space 26 for a displaceable fluid which, in a preferred form, is air. The bladder 20 is shown to be one piece in solid lines in all of the figures. Alternatively, the first and second layers could be defined by separate sheets facially engaged and joined where indicated with dotted lines 28 in FIG. 4. While the bladder 20 can be continuously formed as an endless loop, in a preferred form, the bladder is formed as a tubular strip and is heat sealed at its ends along two lines 30, 32 to define a sealed compartment to confine, or other fluid, within the space 26.

Before connecting the bladder 20 to the crown 12, a cloth sweatband 34, made of a moisture absorbent cloth, is partially assembled to the bladder 20. To facilitate connection of the sweatband 34 to the bladder 20 and the preassembled bladder 20 and sweatband 34 to the crown 12, the bladder layers 22, 24 are heat sealed together to define fused beads 36, 38, respectively at the top edge 40 and bottom edge 42 of the bladder 20. The beads 36, 38 provide a mounting portion to allow the bladder 20 to be stitched therethrough without compromising the seal around the air confining space 26.

The sweatband 34 is wrapped around the top edge 40 of the bladder 20 prior to assembly of the bladder 20 to the crown 12. Stitching 44 extends continuously around the bladder 20 and passes through the bead 36 at the top edge 40 and first and second surrounding sweatband layers 46, 48. This produces a first subassembly which can be attached as a unit to the crown 12.

The bladder 20, with the sweatband 34 partially assembled thereto, is then connected to the crown 12. The sweatband 34 is wrapped around the bottom edge 42 of the bladder 20 prior to assembly. The bottom edge 42 of the bladder is connected to the crown 12 by stitching 50 extending entirely around the circumference of the crown. This stitching 50 extends through the fused bead 38, two sweatband layers 52, 54 and an underturned flap 56 on the crown 12. A reinforcing strip 58 is connected to the flap 56 by stitching 60.

The free ends 62, 64 of the sweatband 34 are overlapped at the rear of the cap 10. A rectangular, cloth, splice element 66 is wrapped around both the top edge 40 and bottom edge 42 of the bladder 20, with the sweatband 34 thereon, to define flaps 68, 70. The bottom flap 70 is sandwiched between the sweatband layer 54 and the crown flap 56 and held in place by the stitching 50 in the same operation that connects the bead 38 to the crown 12.

Once the stitching 50 is completed, the flap 68 is folded around the overlapping sweatband ends 62, 64. A line of stitching 71 is then formed through the sweatband ends 62, 64, two layers of the splicing element 66, and the crown 12. Resultingly, the top edge 40 of the bladder 20 is fixed against the crown 12 at the rear of the cap 10, preferably through only a small circumferential range that is less than 90°. The remainder of the top bladder edge 40 is not attached to the crown 12 so that the bladder 20 and sweatband 34 can be folded downwardly out of the crown opening 18.

One important feature of the present invention is the provision of structure to facilitate forming of the bladder 20 to match the curvature of the crown edge 17. To accomplish this, the first and second bladder layers 22, 24 are connected to each other at regularly spaced intervals around the circumference of the bladder 20. More specifically, the first and second layers 22, 24 are bonded by an adhesive, and more preferably, are fused by heat. Other structure that provides a localized restriction in the bladder 20 is contemplated by the invention.

The heat fusing, in one form, is effected by fusing the first and second layers 22, 24 along two vertically spaced, horizontally extending lines 72, 74. The fuse lines 72, 74 divide the bladder 20 into a plurality of adjoining chambers 76, 78 with their being a restricted passageway 80 between chambers 76, 78. The fuse lines 72, 74 prevent the bladder 20 from expanding fully outwardly thereat. Accordingly, the bladder 20, at the chambers 76, 78, expands more fully than that portion of the bladder 20 in vertical alignment with the fuse lines 72, 74. The result of this is that the bladder 20 tends to hinge at the fuse lines 72, 74. This allows the bladder to bend readily to follow the contour of the crown 12 rather than bridging a large portion of the crown 12, as would occur in the absence of the inventive structure. In a preferred form, the fuse lines 72, 74 are provided at approximately 1½ inch intervals around the circumference of the bladder 20.

While the bladder 20 may be fully enclosed so as to contain only a predetermined amount of displaceable fluid, it is also a desirable feature to change the amount of fluid in the bladder 20 to alter the effective size of the crown opening 18. For this purpose, means are provided at 82 for directing a displaceable fluid into, and allowing exhausting of the fluid from, the bladder 20.

The fluid is directed into the bladder 20 by an enlarged bulb 84. The bulb has a conduit 86 which is in communication with the bladder space 26. By repeatedly depressing the bulb 84, consecutive charges of air are directed into the bladder space 26. The construction of a suitable bulb 84 with a one-way pumping mechanism is known to those skilled in the art.

To exhaust the fluid from the bladder 20, a relief valve is provided at 88. The relief valve 88 has a cylindrical mounting base 90 attached to the bladder 20. The mounting base 90 has a stepped through bore 92 for an actuating button 94. The actuating button 94 has a stem 96 connecting between a blocking head 98 and enlarged actuating head 100. A coil spring 102 surrounds the stem 96 and acts between a shoulder 104 defined by an annular bead 106 on the mounting base 90 and the head 94. The spring 102 normally urges a sealing face 108 on the blocking head 98 facially against a shoulder 110 on the bead 106 to thereby prevent passage of fluid from the space 26 to externally of the bladder 20.

Figure 7:
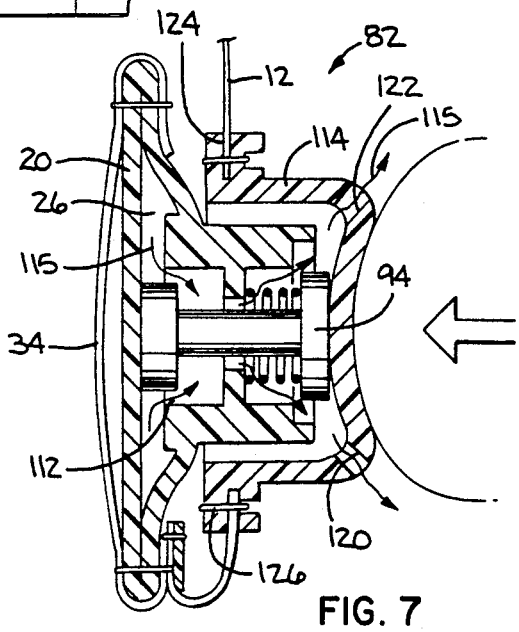
FIG. 7 is a view as in FIG. 6 with the exhausting structure actuated to exhaust fluid from the bladder.

By depressing the button 94, as shown in FIG. 7, the sealing face 108 is moved away from the shoulder 110 to thereby create an annular passageway 112 to allow air from the space 26 to communicate in the direction of arrows 115 out of the space 26.

To interconnect the crown and means 82, a dome-shaped membrane 114 is attached to the crown 12. The membrane defines two cup-shaped receptacles 116, 118 for the bulb 84 and the relief valve 88. The membrane 114 is sufficiently rigid to maintain its shape, but is deformable to allow compression of the bulb 84 and actuating button 94 from externally of the crown 12. The membrane 114 has ports 120, 122 therethrough to allow exhausting of the fluid from the bladder 20 to externally of the membrane 114.

The membrane 114 is preferably preformed of a rubber material and has a circumferential slot 124 for reception of the crown 12. Stitching 126 secures the membrane 114 to the crown 12.

It can be seen that the size of the cap 10 can be readily altered with the cap 10 in place on the head of a wearer. Once the cap 10 is put in place, the user need only actuate the bulb 84 at the back of the head. By simply pressing on the valve 88, the pressure in the bladder 20 can be reduced.

The above construction affords a highly durable cap 10 and one which can be economically manufactured.

The foregoing disclosure of specific embodiments is intended to be illustrative of the broad concepts comprehended by the invention.

What is claimed is:

1. A headwear piece comprising:

a crown having a surface defining an opening for receiving the head of a wearer;

a bladder having first and second overlying layers defining a space therebetween for containing a displaceable fluid, said space having a top and bottom;

first means for connecting the first and second layers to each other between the top and bottom of said space to divide the bladder space into first and second chambers, there being a communication path through said bladder space between the first and second chambers; and second means for connecting the bladder to the crown so that the bladder defines a deformable cushion layer to conform to the head of a wearer.

2. The headwear piece according to claim 1 wherein the first connecting means comprises means for bonding the first and second layers to each other.

3. The headwear piece according to claim 1 wherein the first connecting means comprises means for heat fusing the first and second layers to each other.

4. The headwear piece according to claim 1 wherein the first and second layers are defined as one piece.

5. The headwear piece according to claim 1 wherein the bladder is defined by plastic and the first and second layers are connected at first and second vertically spaced locations between the top and bottom of said space.

6. The headwear piece according to claim 1 wherein the bladder extends through at least 270° around the crown opening.

7. The headwear piece according to claim 1 wherein there are means for bonding the first and second layers together to define a mounting portion on the bladder.

8. The headwear piece according to claim 7 wherein said second connecting means includes means for connecting the mounting portion of the bladder to the crown.

9. The headwear piece according to claim 8 wherein the means connecting the mounting portion of the bladder to the crown comprises stitching means.

10. The headwear piece according to claim 1 in combination with a sweatband wherein there are means for connecting the sweatband to at least one of the bladder and crown so that the bladder resides between the crown and sweatband.

11. The headwear piece according to claim 10 wherein the bladder has top and bottom edges and the means for connecting the sweatband includes means for connecting the sweatband to the bladder along both the top and bottom edges of the bladder.

12. The headwear piece according to claim 11 wherein the first and second layers are bonded to each other along at least one of the top and bottom edges and the means for connecting the sweatband comprises stitching means extending through the bonded portion of the first and second layers at the one of the top and bottom edges.

13. The headwear piece according to claim 10 wherein the bladder has top and bottom edges and the sweatband has a single piece that wraps around each of the top and bottom bladder edges.

14. The headwear piece according to claim 13 wherein the means for connecting the sweatband includes stitching through at least one of the bladder edges, at least two layers of the sweatband, and the crown.

15. The headwear piece according to claim 1 in combination with a means for directing a displaceable fluid into and allowing exhausting of a displaceable fluid from the bladder space.

16. The headwear piece according to claim 15 wherein the fluid directing means includes a depressible actuator.

17. The headwear piece according to claim 16 wherein the crown has an integrally formed receptacle for the depressible actuator.

18. The headwear piece according to claim 17 wherein the receptacle is defined by a membrane that is deformable to operate the depressible actuator from externally of the crown.

19. The headwear piece according to claim 15 wherein said fluid directing means includes a relief valve that is operable to allow fluid in the bladder to exhaust to externally of the crown.

20. The headwear piece according to claim 19 wherein the crown has an integral membrane that is deformable from externally of the crown to operate the relief valve and exhaust fluid from the bladder.

21. The headwear piece according to claim 20 wherein the membrane has a port therein to allow the fluid to exhaust from the bladder space to externally of the crown.

22. The headwear piece according to claim 1 wherein the bladder has top and bottom edges and the first connecting means comprises means for bonding the first and second layers to each other to define a restricted passageway between the first and second chambers.

23. The headwear piece according to claim 1 wherein the bladder has top and bottom edges extending through at least 270° around the crown opening, and the means for connecting the bladder to the crown includes means for connecting the top bladder edge to the crown and means for connecting the bottom bladder edge to the crown.

24. The headwear piece according to claim 23 wherein the means for connecting the bottom edge connects substantially the entire length of the bottom edge to the crown.

25. The headwear piece according to claim 24 wherein the means connecting the top edge connects the top edge to the crown at only one location extending through less than 90°.

26. The headwear piece according to claim 1 wherein the crown is made at least partially from a deformable material.

27. The headwear piece according to claim 1 wherein the headwear piece is a baseball-type cap.

28. A headwear piece comprising:

a crown having a surface defining an opening for receiving the head of a wearer;

a tubular bladder having a top and bottom and defining a space for containing a displaceable fluid, said tubular bladder space having a portion with a uniform height;

means for restricting the space at a first location on the tubular bladder so that the restricting means divides the bladder space along the bladder portion into first and second chambers, the bladder space being expandable to a greater extent at said first and second chambers than at said restricting means so that the bladder tends to bend at the first location to conform to the contour of the crown opening; and means for connecting the bladder to the crown so that the bladder defines a deformable cushion layer to conform to the head of a wearer.

29. The headwear piece according to claim 28 wherein the crown has a flexible portion against which the bladder can bear with the headwear piece on the head of a wearer, the bladder has first and second overlying layers and the restricting means comprises means cooperating between the first and second layers between the top and bottom of the bladder.

30. The headwear piece according to claim 29 wherein the bladder is defined by a single piece of flexible material.

31. The headwear piece according to claim 30 wherein the bladder extends through at least 270° around the crown opening.

32. The headwear piece according to claim 29 in combination with a sweatband wherein there are means for connecting the sweatband to at least one of the bladder and crown so that the bladder resides between the crown and sweatband.

33. The headwear piece according to claim 32 wherein the means for connecting the sweatband includes means for connecting the sweatband to the bladder along both the top and bottom of the bladder.

34. The headwear piece according to claim 29 in combination with a means for directing a displaceable fluid into and allowing exhausting of a displaceable fluid from the bladder space.

35. The headwear piece according to claim 34 wherein the fluid directing means includes a depressible actuator.

36. The headwear piece according to claim 35 wherein the crown has an integrally formed receptacle for the depressible actuator.

37. The headwear piece according to claim 36 wherein the receptacle is defined by a membrane that is deformable to operate the depressible actuator from externally of the crown.

38. The headwear piece according to claim 34 wherein said fluid directing means includes a relief valve that is operable to allow fluid in the bladder to exhaust to externally of the crown.

39. The headwear piece according to claim 28 wherein the headwear piece is a baseball-type cap.

* * * * *